United States Patent [19]

Galera

[11] Patent Number: 4,757,828

[45] Date of Patent: Jul. 19, 1988

[54] CIGARETTE HOLDER AND FILTER INSERT THEREFOR

[76] Inventor: Rafael Galera, Emiliano Zapata No. 70 -Tepepan Xochimilco, 16020 México, D. F., Mexico

[21] Appl. No.: 841,212

[22] Filed: Mar. 19, 1986

[51] Int. Cl.[4] ..... A24D 3/04

[52] U.S. Cl. ..... 131/229; 131/187; 131/216

[58] Field of Search ..... 131/229, 187, 216

[56] References Cited

U.S. PATENT DOCUMENTS 459,730 9/1891 Schoch ..... 131/229

3,279,477 10/1966 Sandblast ..... 131/229

FOREIGN PATENT DOCUMENTS 1407700 6/1965 France ..... 131/229

0381876 10/1932 United Kingdom ..... 131/229

*Primary Examiner*—V. Millin

*Attorney, Agent, or Firm*—Roylance, Abrams, Berdo & Goodman

[57] ABSTRACT

A cigarette holder and an insert for a conventional cigarette holder, including a first chamber for receiving the butt end of the cigarette and a second chamber for condensing the noxious elements of tobacco smoke. The two chambers are connected by an opening such that the smoke travels from the first chamber to the second chamber. The second chamber has an end plate opposite the opening, but has spaced orifices in its side walls through which the smoke passes. The cross-sectional area of the second chamber is less than the cross-sectional area of the first chamber and increases from the open end to the end plate. The second chamber is designed to create turbulences therein.

11 Claims, 3 Drawing Sheets

FIG. 1
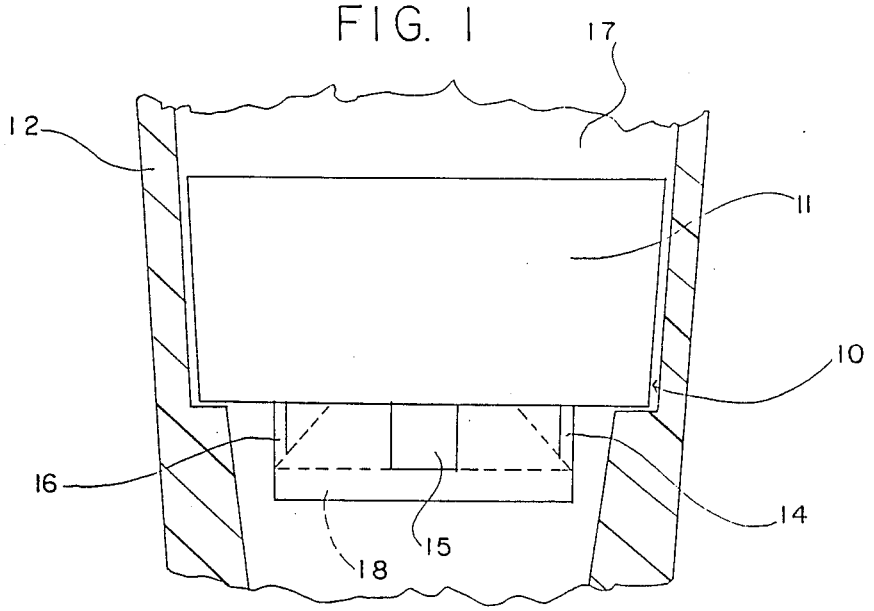
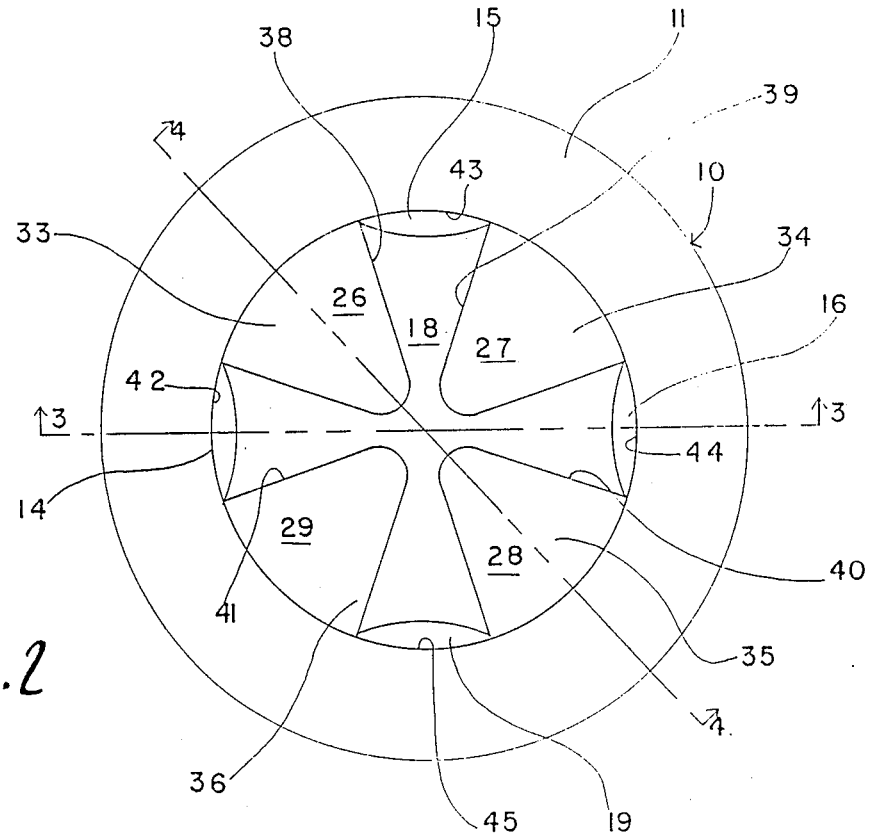
FIG. 2

CIGARETTE HOLDER AND FILTER INSERT THEREFOR

FIELD OF THE INVENTION

This invention relates to cigarette holders which are designed to receive cigarettes in one end and have a mouthpiece at the other end. More particularly, this invention relates to such cigarette holders which reduce the noxious elements inhaled during smoking of cigarettes.

BACKGROUND OF THE INVENTION

Conventional cigarette holders are well known and are generally comprised of two pieces, a first tubular part in which one end of the cigarette is inserted, and a second tubular piece constituting the actual mouthpiece which is engaged by the lips of the smoker. The mouthpiece is connected at one end to the first tubular part and is flattened at its free end to form the mouthpiece proper. These two parts are usually connected by mating screw threads. Between these two pieces is affixed a cylindrical tube including a metallic piece at the approximate center thereof. This metal piece is generally tubular, although it may adopt other forms, and acts as a condenser to condense the undesirable and noxious materials that the smoke of a lighted cigarette carries with it in the form of vapors.

These known cigarette holders have the disadvantage that the metallic condenser tube gradually heats up with the hot smoke and soon loses its capacity for condensation. Thus, after a period of continuous use, the noxious smoke passes directly through the device into the smoker. This disadvantage makes conventional cigarette holders ineffective. In addition, because of the small contact surface area between the condenser and the cigarette smoke, these holders do not have a large condensing capacity, even when the condenser is cool.

The above disadvantages are resolved by means of the improved cigarette holder of the present invention. In addition, this invention provides an insert which cn be inserted into present cigarette holders to improve their ability to remove noxious elements from the smoke inhaled by users of the holders. Smoke received in the cigarette holders and inserts according to this invention undergoes more circulation in the condensation chambers, in comparison with conventional holders, so that the noxious components of the smoke are more completely condensed in these chambers.

SUMMARY OF THE INVENTION

This invention refers to an improved cigarette holder, and to an insert for a conventional cigarette holder, which provides chambers within the holder for the circulation of smoke. One of the chambers has various perforations through which the cigarette smoke penetrates. The employment of a plurality of chambers, one having perforations therein, results in very efficient circulation of the smoke within the chambers, thereby achieving a much more effective condensation of noxious elements than in any conventional cigarette holder.

Hence, one of the objects of the present invention is to provide an improved holder for cigarettes (and an insert for a conventional cigarette holder), having a condensation chamber for undesirable components and which at the same time allows for the efficient circulation of cigarette smoke.

A further object of the invention is that the condensation chamber circulates the smoke with turbulence to obtain continuous condensation of the noxious components.

Yet another object of the invention is to avoid the unnecessary overheating of the condensation chamber, in contrast to conventional cigarette holders.

The foregoing objects and other objects of the invention are fully described below.

BRIEF DESCRIPTION OF THE DRAWINGS

FIG. 1 is a side view of one embodiment of an insert according to this invention, showing the insert in a conventional cigarette mouthpiece.

FIG. 2 is a top view of the embodiment of this invention illustrated in FIG. 1.

DETAILED DESCRIPTION OF THE INVENTION

Figure 3:
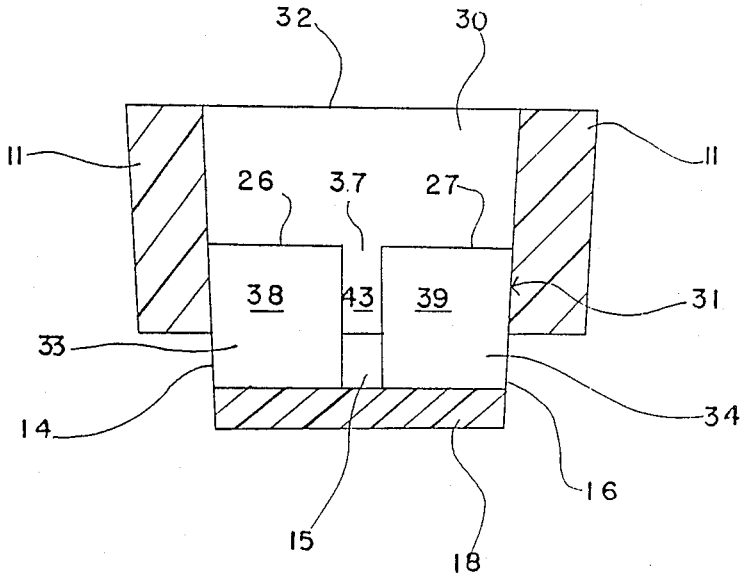
FIG. 3 is a side cross-sectional view taken along line 3—3 of FIG. 2.

Certain embodiments of the invention will now be described as illustrated in the accompanying drawings wherein:

Referring to the embodiment illustrated in FIGS. 1–4, this invention comprises insert 10 which is comprised of two chambers, upper chamber 30 and lower chamber 31. Insert 10 is designed to fit within conventional cigarette mouthpieces such as in chamber 17 of mouthpiece 12 (see FIG. 1).

Insert 10 is comprised of continuous side wall 11, wall segments 33, 34, 35 and 36 and bottom plate 18. Wall segments 33, 34, 35 and 36 have top surfaces 26, 27, 28 and 29 and side faces 38, 39, 40 and 41, respectively. Top surfaces 26, 27, 28 and 29 are flat co-planar surfaces. Side faces 38, 39, 40 and 41 are curved surfaces (see FIG. 2) which taper from their top edge to their bottom edge (see FIG. 4).

Figure 4:
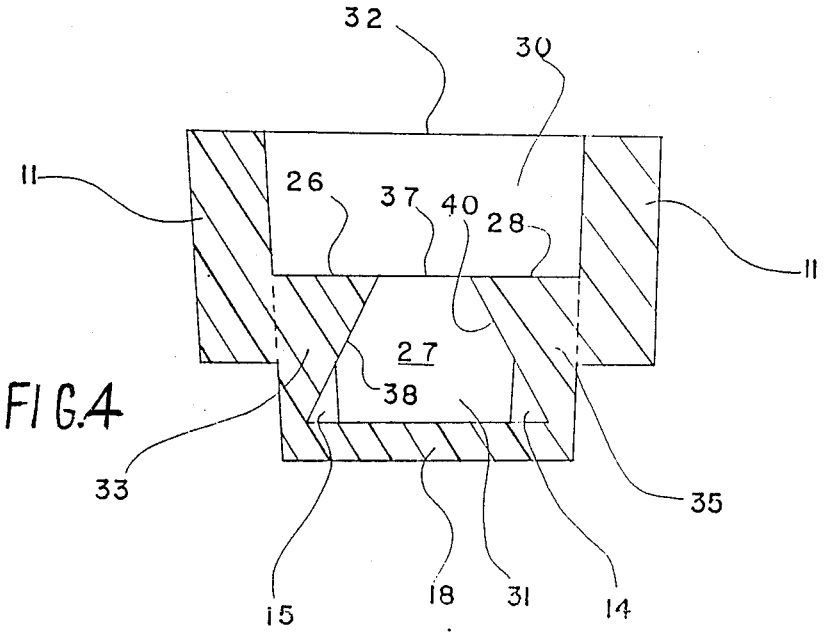
FIG. 4 is a side cross-sectional view taken along line 4—4 of FIG. 2.

Upper chamber 30 is defined by continuous side wall 11 (see FIGS. 3 and 4). Chamber 30 is in the shape of a truncated cone in the embodiment illustrated in FIGS. 1–4. Chamber 30 may be of other shapes, including cylindrical. Upper chamber 30 has an upper end 32 which is open and a lower end formed by top surfaces 26, 27, 28 and 29 and opening 37 (see FIGS. 3 and 4). Upper chamber 30 is designed to receive the butt end of a cigarette through upper end 32 or for upper end 32 to be adjacent to the butt end.

Lower chamber 31 is formed by side surfaces 38, 39, 40 and 41, opening 37, bottom plate 18 and recessed wall portions 42, 43, 44 and 45. Recessed wall portions 42, 43, 44 and 45 are formed by the continuation of the inside surface of upper chamber 30 into lower chamber 31. That is, wall portions 42–45 form a continuous surface with upper chamber 30 between wall segments 33–36 (see FIG. 3).

Orifices 14, 15, 16 and 19 are formed in the side wall of lower chamber 31. The size of these orifices is exaggerated in the Figures for clarity. Orifices 14–16 and 19 are formed by the continuation of recessed wall portions 42–45 below side wall 11 (see FIGS. 1 and 3). The lower edges of orifices 14–16 and 19 are formed by bottom plate 18.

Bottom plate 18 is a continuous plate which closes off the bottom of lower chamber 31.

Figure 5:
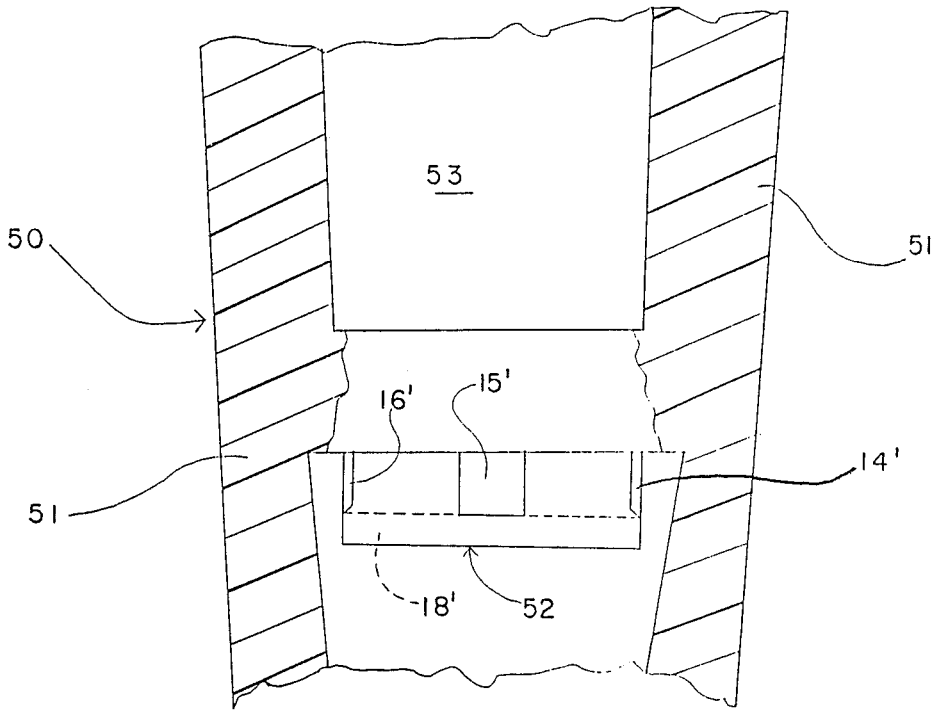
FIG. 5 is a partial side view, partially cross sectioned for clarity, of a second embodiment of this invention.

FIG. 5 illustrates a second embodiment of this invention wherein the condensation chambers are an integral part of a cigarette mouthpiece, mouthpiece 50. Mouthpiece 50 comprises an outer continuous wall 51 and a filter section 52.

Upper chamber 53 (analogous to chamber 30) is formed in the upper part of mouthpiece 50, above filter section 52. The butt end of a cigarette is received within upper chamber 53.

Filter section 52 is designed the same as lower chamber 31 of insert 10, with orifices 14', 15' and 16' and bottom plate 18'.

The flow of the cigarette smoke is from the top to the bottom in FIGS. 1 and 3–5. Thus the smoke travels from upper chamber 30 (or 53) to lower chamber 31 (or filter Section 52). The design of the chambers results in the creation of turbulence in the smoke, thus increasing the condensation of noxious elements from the smoke.

Certain embodiments of this invention may be comprised of plastic. In these embodiments, the chambers or filter sections will not heat up as quickly as if metal were employed. This results in an even greater capability to remove noxious elements from smoke.

With the above structure of physical effects of circulation and condensation of the smoke and the noxious components thereof are obtained, as a precalculated turbulence of the smoke occurs which, together with the cool walls that do not overheat excessively due to the efficient circulation of the smoke, give rise to an excellent condensing effect that is not observed in conventional devices and holders. For these reasons, the cigarette holders embodied by this invention are far superior to those which are already known.

Once given the above disclosure, other embodiments, improvements and modifications will become apparent to those skilled in the art. Such other embodiments, improvements and modifications are considered to be within the scope of this invention as defined by the following claims:

I claim:

1. An insert for a cigarette holder comprising an upper chamber and a lower chamber, each of said chambers having an upper end, a lower end and a side wall;

said upper end of said lower chamber opening into said lower end of said upper chamber, said upper end of said upper chamber being open, said lower end of said lower chamber being closed;

said lower chamber having a smaller cross section than said upper chamber, the cross-sectional area of said lower chamber, perpendicular to the longitudinal axis of the lower chamber, increasing from said upper end to said lower end;

said lower chamber having a plurality of spaced holes in its said side wall.

2. An insert according to claim 1 wherein said upper chamber is in the shape of a truncated cone.

3. An insert according to claim 1 wherein said lower chamber is formed at the bottom by an end plate and at the side, in part, by spaced wall segments, each of said wall segments having top and side surfaces.

4. An insert according to claim 3 wherein said wall segments diminish in cross-sectional area, perpendicular to the longitudinal axis of said lower chamber, from said upper end to said lower end of said lower chamber.

5. An insert according to claim 3 wherein the top surfaces of said side walls form in part the lower end of said upper chamber.

6. An insert according to claim 3 wherein said orifices are formed between said adjacent pairs of said wall segments and are adjacent to said end plate.

7. A cigarette holder comprising an outer wall; and a filter chamber having upper and lower ends and a side wall;

said outer wall having a portion above the filter section which forms an upper chamber, said upper chamber having upper and lower ends, said upper end being designed to receive a cigarette therein, said lower end opening into said upper end of said filter chamber;

said lower end of said filter chamber being closed;

said filter chamber having a smaller cross section than said upper chamber, the cross-sectional area of said filter chamber, perpendicular to the longitudinal axis of the holder, increasing from said upper end to said lower end;

said side wall of said filter chamber having a plurality of spaced holes therein.

8. A cigarette holder according to claims 7 wherein said filter chamber is formed at the bottom by an end plate and at the side, in part, by spaced wall segments, each of said wall segments having top and side surfaces.

9. A cigarette holder according to claim 8 wherein said wall segments diminish in cross-sectional area, perpendicular to the longitudinal axis of said filter chamber, from said upper end to said lower end of said filter chamber.

10. A cigarette holder according to claim 8 wherein said top surfaces of said side walls form in part the lower end of said upper chamber.

11. A cigarette holder according to claim 8 wherein said orifices are formed between adjacent pairs of said wall segments and are adjacent to said end plate.

* * * * *